US007303448B1

(12) United States Patent
Sproesser

(10) Patent No.: US 7,303,448 B1
(45) Date of Patent: Dec. 4, 2007

(54) BATTERY TERMINAL CONNECTOR WITH REVERSIBLE CLAMP LEVER

(75) Inventor: George S. Sproesser, Leesport, PA (US)

(73) Assignee: East Penn Manufacturing Co., Inc., Lyon Station, PA (US)

( * ) Notice: Subject to any disclaimer, the term of this patent is extended or adjusted under 35 U.S.C. 154(b) by 0 days.

(21) Appl. No.: 11/420,142

(22) Filed: May 24, 2006

(51) Int. Cl.
*H01R 4/50* (2006.01)

(52) U.S. Cl. ..... 439/773; 439/772

(58) Field of Classification Search ..... 439/773, 439/772, 754
See application file for complete search history.

(56) References Cited

U.S. PATENT DOCUMENTS

| | | | | |
|---|---|---|---|---|
| 1,696,531 | A | 12/1928 | Eaton | |
| 1,814,156 | A | 7/1931 | Hedges | |
| 1,873,775 | A | 8/1932 | McMaster | |
| 1,941,773 | A | 1/1934 | Wright | |
| 1,977,179 | A | 10/1934 | Fisch | |
| 2,878,460 | A | 3/1959 | Coleman | |
| 3,084,306 | A | 4/1963 | Cribbs | |
| 3,521,223 | A | 7/1970 | Martinez | |
| 3,568,139 | A | 3/1971 | Delzer | |
| 3,838,386 | A | 9/1974 | Chartain | |
| 4,385,796 | A | 5/1983 | Eriksson | |
| 4,537,460 | A | 8/1985 | McCaig | |
| 4,555,159 | A | 11/1985 | Chartrain | |
| 4,964,819 | A | 10/1990 | Caraballo | |
| 5,024,619 | A * | 6/1991 | Caraballo | 439/755 |
| 5,269,709 | A | 12/1993 | Eriksson | |
| 5,389,466 | A | 2/1995 | Inoue et al. | |
| D363,699 | S | 10/1995 | Mountfort | |
| 5,556,309 | A | 9/1996 | Sharpe et al. | |
| 5,588,883 | A | 12/1996 | Hattori | |
| 6,524,141 | B2 * | 2/2003 | Endo | 439/773 |
| 6,773,310 | B2 | 8/2004 | Davis | |
| 6,802,747 | B1 | 10/2004 | Orange | |
| 6,971,925 | B1 | 12/2005 | Orange | |

FOREIGN PATENT DOCUMENTS

| | | |
|---|---|---|
| WO | 9703480 | 7/1996 |

* cited by examiner

*Primary Examiner*—Michael C. Zarroli
(74) *Attorney, Agent, or Firm*—Barley Snyder LLC

(57) ABSTRACT

A battery terminal connector comprises a main body including a clamp having first and second flanges extending from ends thereof and a terminal receiving member extending from the first flange. A lever is removeably attached to the first and second flanges by a threaded shaft and a knurled nut. The lever is connected to the threaded shaft by an eyelet and is rotatable between an open position and a closed position. The lever pulls the first and second flanges toward each other in the closed position. A ring terminal has a ring connected to the terminal receiving member.

35 Claims, 4 Drawing Sheets

FIG. 4
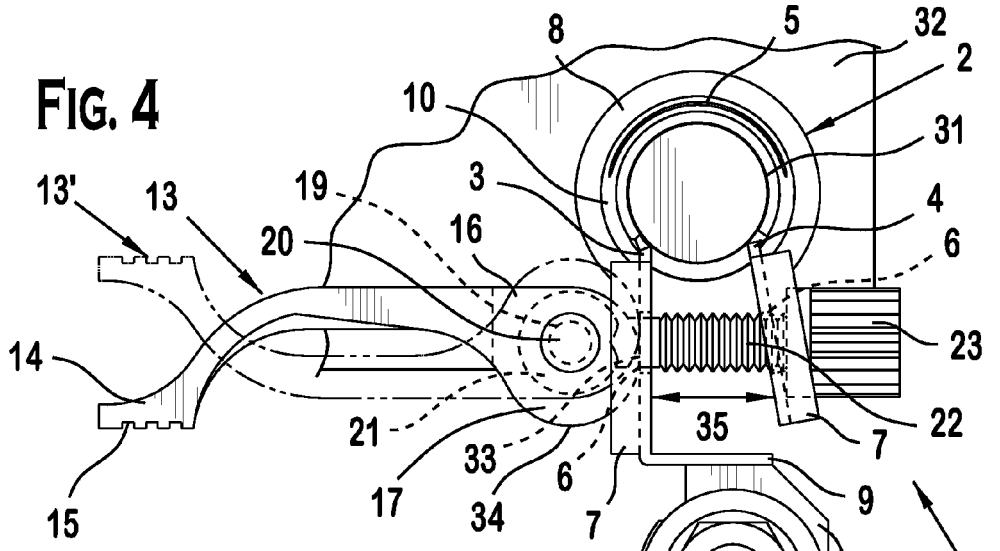
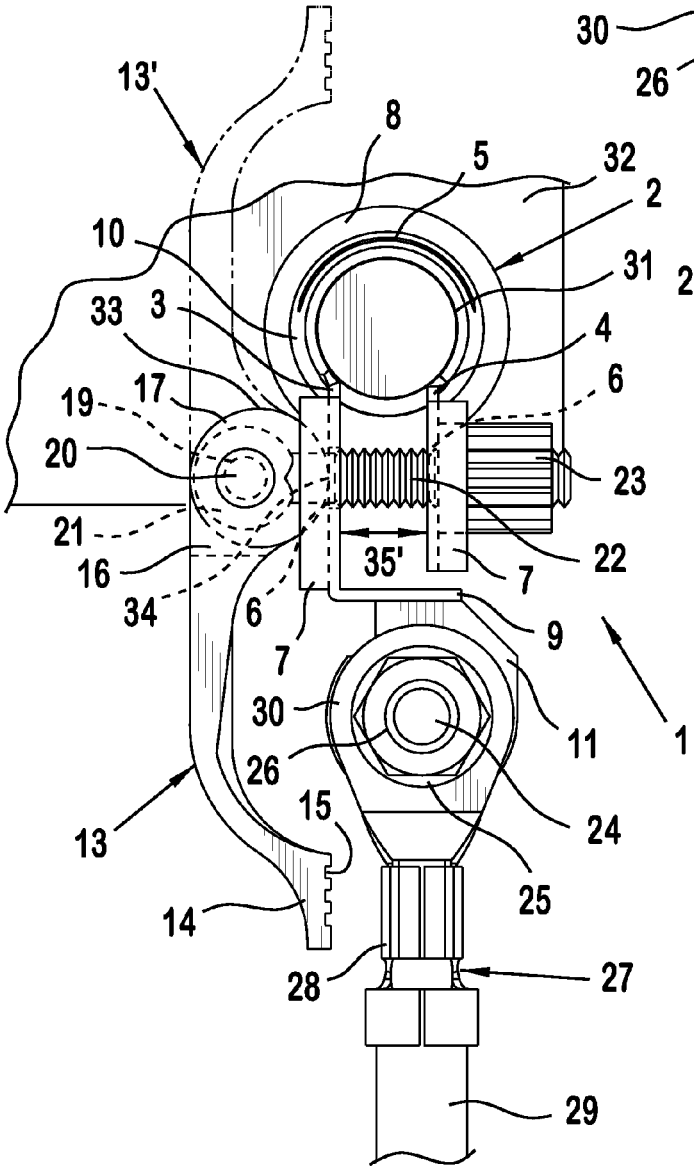
FIG. 5

BATTERY TERMINAL CONNECTOR WITH REVERSIBLE CLAMP LEVER

FIELD OF THE INVENTION

The invention relates to a battery terminal connector with a reversible clamp lever. More specifically, the invention relates to a battery terminal connector having a clamp with first and second flanges extending there from that are actuated by a reversible non-conductive lever to secure the battery terminal connector to a terminal of a battery.

BACKGROUND

Conventional battery terminal connectors comprise a first end having a clamp with spaced end portions that receive a bolt and a second end with a ring terminal consisting of a cable termination. In use, an electrical cable is attached to the battery terminal connector using the cable termination which may include a variety of clamping or crimping arrangements. The clamp is inserted over a terminal of a battery, and a nut is applied to an end of the bolt. The nut is tightened to force the spaced end portions of the clamp together thereby securing the clamp to the battery terminal. To remove the clamp from the battery terminal, the nut is loosened from the bolt.

These conventional battery terminal connectors have a disadvantage in that tools must be used to effectively tighten and loosen the bolt. Assembly of the battery terminal connector is therefore time consuming and complicated, especially if the terminal and/or the battery is not conveniently located. Because the entire battery terminal connector is generally formed of a conductive material, there is a risk of accidental shock or short circuiting during the assembly and disassembly thereof. Additionally, these conventional battery terminal connectors do not provide an easy or reliable method for attachment of an electrical cable thereto.

To address some of these concerns, battery terminals which do not require tools for assembly have been developed. An example of such a known battery terminal is disclosed by Orange in U.S. Pat. No. 6,971,925 entitled Rotatable Connector for a Battery Cable Clamp. That battery clamp is disclosed as having first and second legs extending from a post section. A connecting pin passes through apertures formed in each leg such that it is coupled to a handle on one end and an end nut on an opposite end thereof. The connecting pin also passes through a seat upon which a boss of the handle rests during rotation to facilitate a clamping action between the legs. On a rear end of the clamp, a cable joining section is provided as a threaded post which is secured to a flat plate. Although the design disclosed in this reference presents a desirable tool-less clamping operation, it has several drawbacks in that a seat is required to facilitate clamping and also presents a drawback in that the flat plate for supporting the threaded post may bend or otherwise break away from the remainder of the assembly. Additionally, the design disclosed in this reference requires many individual parts, which makes the design more costly and difficult to assemble.

SUMMARY

The invention provides a battery terminal connector comprising a clamp having opposing first and second flanges extending from ends thereof. A terminal receiving member extends from the first flange. A non-conductive lever is removeably attached to the first and second flanges by a threaded shaft and a knurled nut. The lever is rotatable between an open position and a closed position. The lever and the knurled nut pull the first and second flanges toward each other in the closed position. A ring terminal has a ring connected to the terminal receiving member.

The invention further provides a battery terminal connector comprising a main body including a clamp having first and second flanges extending from ends thereof and a terminal receiving member extending from the first flange. A lever is removeably attached to the first and second flanges. The lever has an eccentric portion with first and second drive members. The first and second drive members have a rod extending therebetween that is positioned closer to a side edge than a bottom edge of the first and second drive members. The lever is rotatable between an open position where the side edges engage the first flange and a closed position where the bottom edges engage the first flange. The lever pulls the first and second flanges toward each other in the closed position. A ring terminal has a ring connected to the terminal receiving member.

The invention still further provides a battery terminal connector comprising a main body including a clamp having first and second flanges extending from ends thereof and a terminal receiving member extending from the first flange. The terminal receiving member is substantially plate-like and extends substantially perpendicular to the first flange. A lever is removeably attached to the first and second flanges by a threaded shaft and a knurled nut. The lever is connected to the threaded shaft by an eyelet and is rotatable between an open position and a closed position. The lever pulls the first and second flanges toward each other in the closed position.

BRIEF DESCRIPTION OF THE DRAWINGS

The invention will now be described by way of example with reference to the accompanying drawings wherein a brief description of each figure is provided below.

FIG. 4 is a top view of the battery terminal connector shown positioned on a battery terminal with a lever in an open position and arranged on a side of a first flange.

FIG. 5 is a top view of the battery terminal connector shown positioned on the battery terminal with the lever in a closed position and arranged on the side of the first flange.

DETAILED DESCRIPTION OF THE EMBODIMENT(S)

Figure 1:
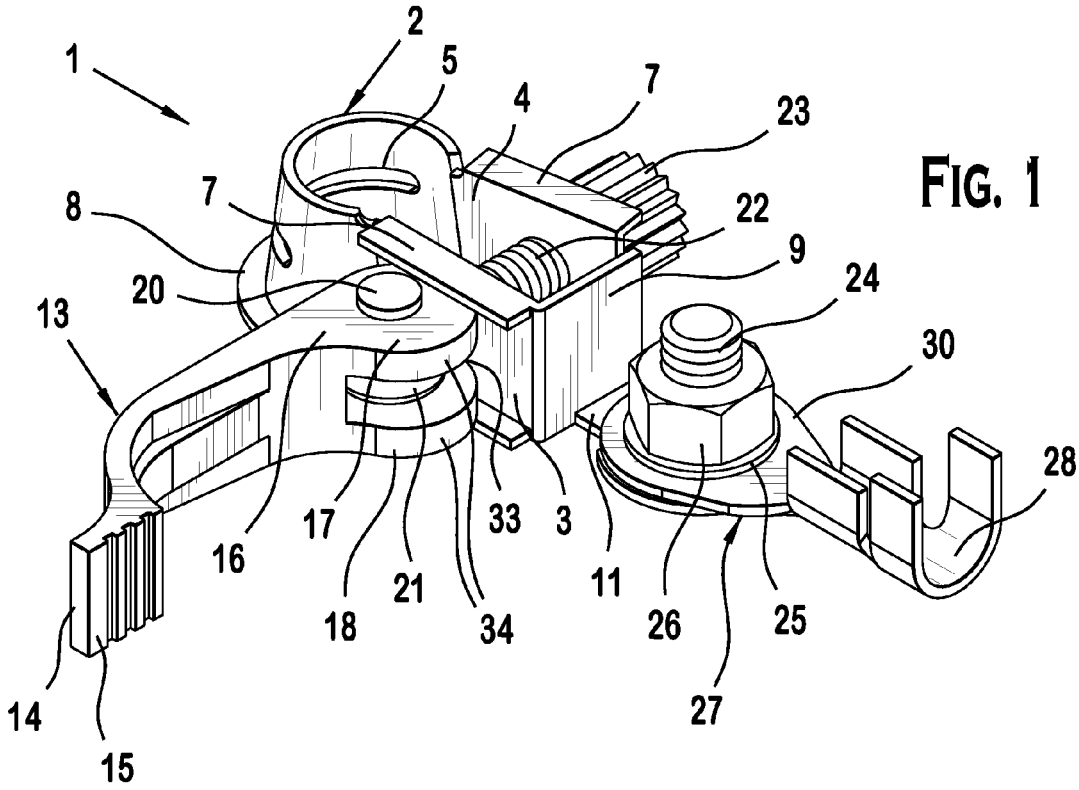
FIG. 1 is a top perspective view of a battery terminal connector according to the invention.
Figure 2:
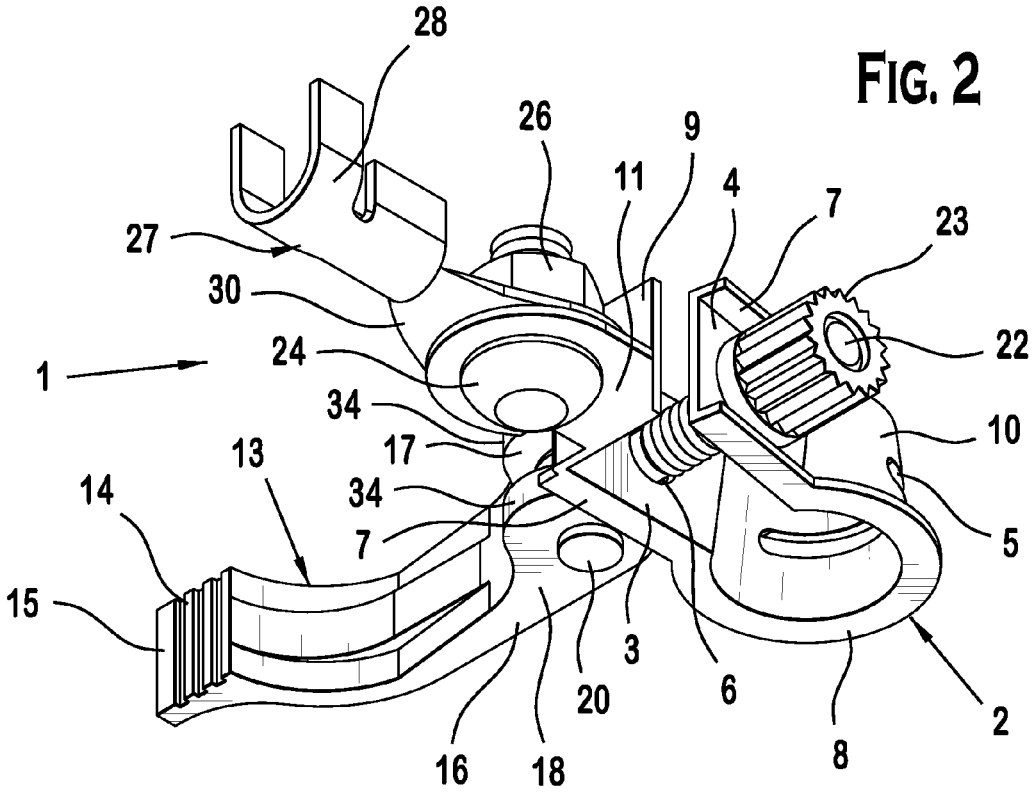
FIG. 2 is a bottom perspective view of the battery terminal connector.
Figure 3:
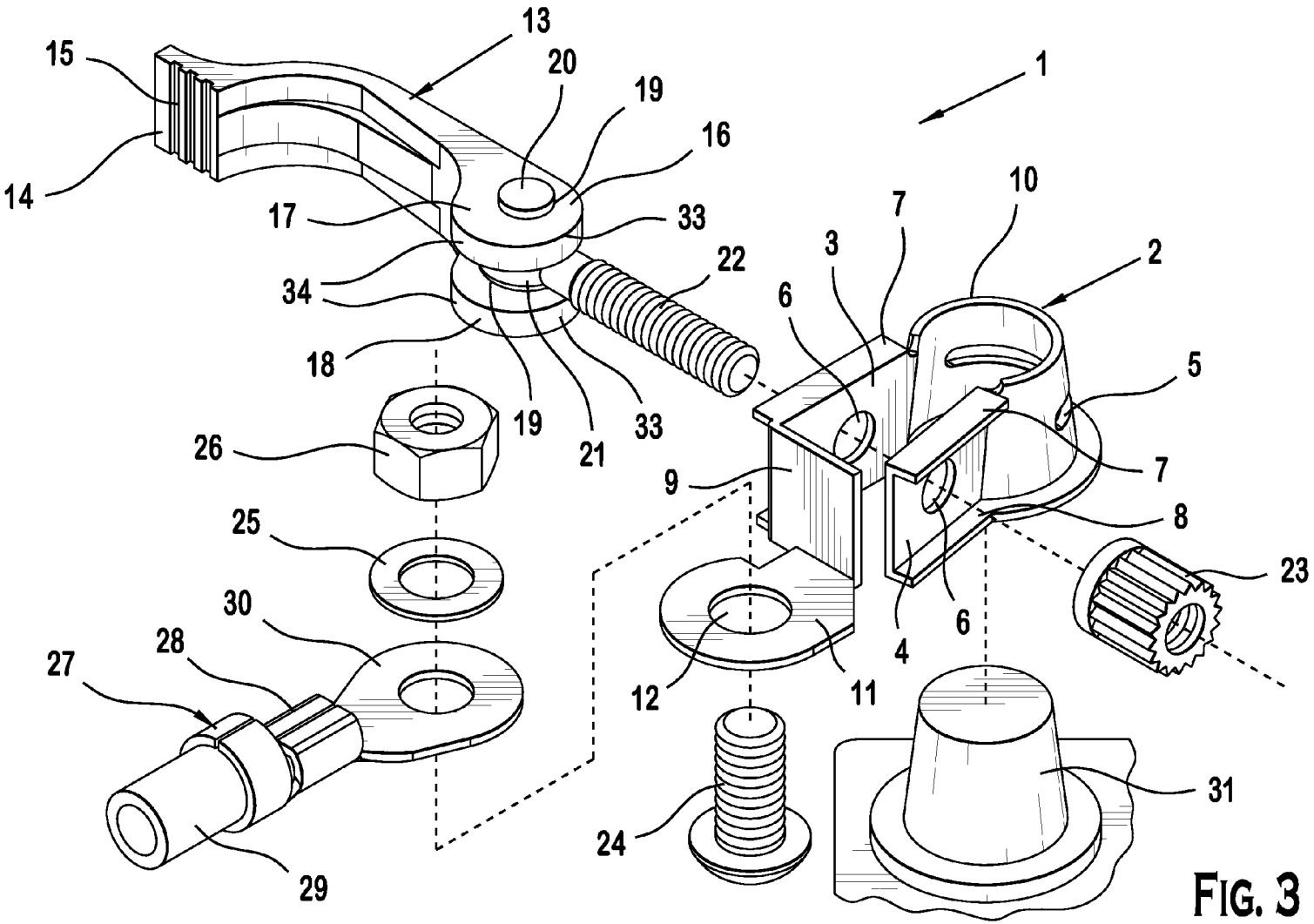
FIG. 3 is an exploded view of the battery terminal connector.
Figure 6:
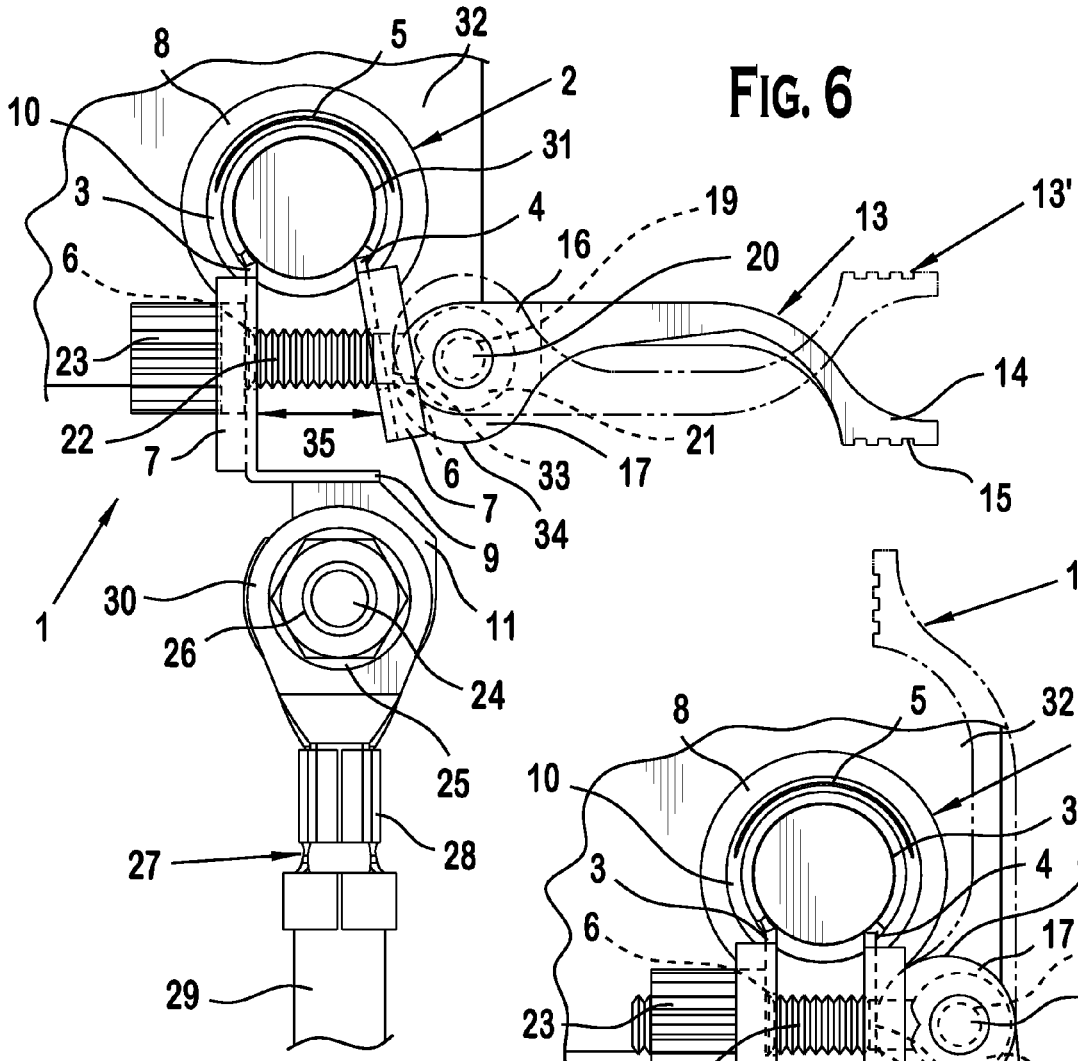
FIG. 6 is a top view of the battery terminal connector shown positioned on the battery terminal with the lever in the open position and arranged on a side of a second flange.

FIGS. 1 and 2 show a battery terminal connector 1 according to the invention. The battery terminal connector 1 includes a main body 2, a lever 13, and a ring terminal 27. As shown in FIG. 3, the main body 2 comprises a substantially c-shaped clamp 10 having opposing first and second flanges 3, 4, respectively, extending from ends thereof. The clamp 10 has an elongated slot 5 extending about a circumference thereof. The first flange 3 extends substantially parallel to the second flange 4 and is spaced a distance 35 therefrom, as shown in FIGS. 4 and 6. As shown in FIG. 3, each of the first and second flanges 3, 4 are provided with a lever connecting opening 6. The lever connecting openings 6 are formed at positions substantially opposing each other. Extensions 7 extend from top surfaces of the first and second flanges 3, 4 and are positioned substantially perpendicular thereto. A second extension 8 extends from a bottom surface of the first and second flanges 3, 4 and the clamp 10 and is positioned substantially perpendicular thereto. The clamp 10 and the first and second flanges 3, 4 are formed to be resilient. The clamp 10 may be formed to have an internal surface with a size and taper corresponding to a respective battery terminal 31 (FIG. 3). For example, the internal surface of the clamp 10 may be formed to have a size and taper corresponding to either a true positive Society of Motor Engineers (SAE) specification battery terminal or a true negative SAE specification battery terminal.

A side wall 9 extends from the first flange 3 and is positioned substantially perpendicular thereto. The side wall 9 extends from the first flange 3 generally toward the second flange 4. A terminal receiving member 11 extends from the side wall 9 and is positioned substantially perpendicular thereto. This arrangement of the side wall 9 extending from the first flange 3 to support the terminal receiving member 11 results in an improved construction thus reducing the risk of bending or fracture of the terminal receiving member 11. A terminal attachment opening 12 extends through the terminal receiving member 11. A threaded stud 24 that receives a washer 25 and a nut 26 extends through the terminal attachment opening 12 and is fixed thereto, for example, by swaging or clinching. It should be understood that the threaded stud 24 may be secured in the terminal attachment opening 12 by other known methods, such as by welding, by a frictional fit, or by using a suitable fastener.

The main body 2 may be integrally formed, for example, from a conductive material having spring back properties, such as a tin plated brass alloy. It should be understood, however, that other suitable conductive materials having resilient properties may be utilized.

As shown in FIGS. 1 and 2, the ring terminal 27 comprises a ring 30 and a crimp member 28. The ring 30 has an opening corresponding to the terminal attachment opening 12. The ring terminal 27 may be integrally formed of a conductive material.

As shown in FIG. 3, the lever 13 has a first end with a gripping member 14 and a second end with an eccentric portion 16. The gripping member 14 has a plurality of ribs 15. The eccentric portion 16 includes substantially circular first and second driving members 17, 18, respectively. The first driving member 17 extends substantially parallel to the second driving member 18 and is spaced therefrom. Each of the first and second driving members 17, 18 are provided with an attachment member receiving opening 19. The attachment member receiving openings 19 are formed at positions substantially opposing each other. Each of the attachment member receiving openings 19 are arranged such that the attachment member receiving openings 19 are positioned closer to a side edge 33 of the respective first or second driving member 17, 18 than a bottom edge 34 of the respective first or second driving member 17, 18. The lever 13 may be formed, for example, from a non-conductive material, such as nylon. The lever 13 may be colored, for example, to indicate positive and negative polarity. For example, the color of the lever 13 may coincide with the size and taper of the internal surface of the clamp 10, such that the lever 13 indicates whether the clamp 10 is formed to be mated with a true positive SAE specification battery terminal or a true negative SAE specification battery terminal.

A rod 20 extends between the attachment member receiving openings 19 and passes through an eyelet 21 formed at an end of a threaded shaft 22. The threaded shaft 22 extends through the connecting openings 6 in the first and second flanges 3, 4 and is attached thereto by a knurled nut 23, as shown in FIGS. 1-2. It should be understood that while a knurled nut is shown in this embodiment, the invention anticipates the use of other nuts or suitable fasteners and in particular those that can be tightened by hand. The threaded shaft 22 extends through the connecting openings 6 in the first and second flanges 3, 4 so that the knurled nut 23 may be threaded on the threaded shaft 22 on a side of the first flange 3 or on a side of the second flange 4. The lever 13 can therefore be positioned on either side of the main body 2 depending on the desired configuration of the battery terminal connector 1, as shown in FIGS. 4-7. The lever 13 is rotatable about the rod 20, moving the eyelet 21 and threaded shaft between an open position shown in FIGS. 4 and 6 and a closed position shown in FIGS. 5 and 7.

Figure 7:
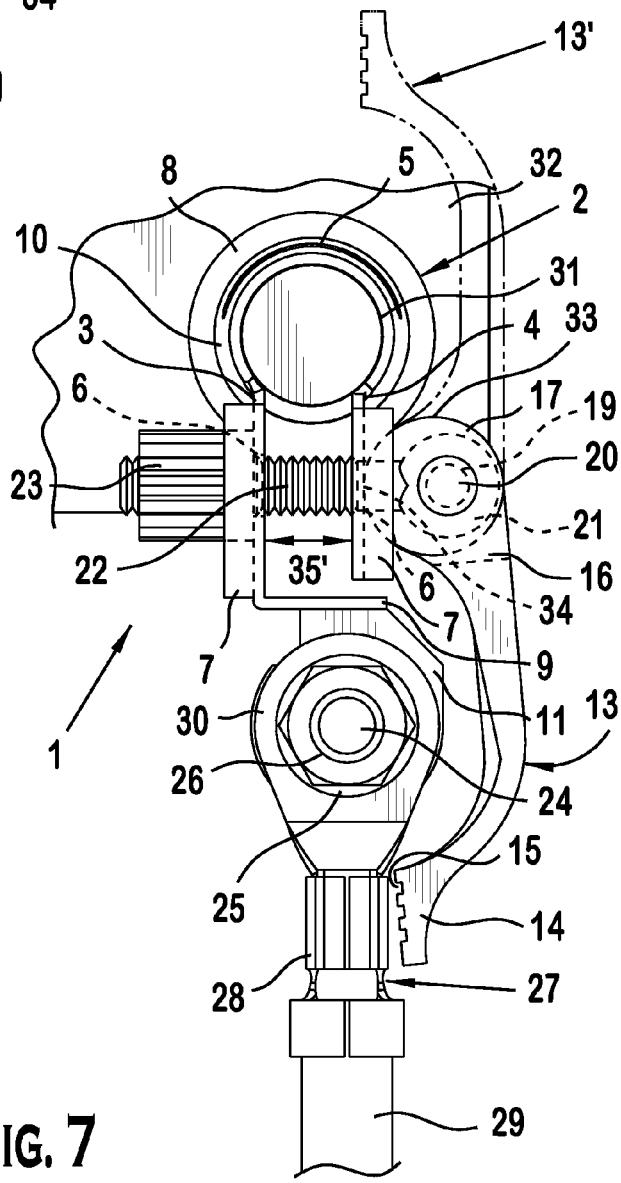
FIG. 7 is a top view of the battery terminal connector shown positioned on the battery terminal with the lever in the closed position and arranged on the side of the second flange.

The assembly and operation of the battery terminal connector 1 will now be described in greater detail with reference to FIGS. 4-7. FIGS. 4 and 5 show the battery terminal connector 1 assembled with the lever 13 positioned on a side of the first flange 3 of the main body 2. FIGS. 6 and 7 show the battery terminal connector 1 assembled with the lever 13 positioned on a side of the second flange 4 of the main body 2.

The assembly of the battery terminal connector 1 with the lever 13 positioned on the side of the first flange 3 of the main body 2 will first be described. As shown in FIG. 4, the threaded shaft 22 is inserted through the connecting opening 6 in the first flange 3 and then the connecting opening 6 in the second flange 4. During insertion, the lever 13 is positioned in the open position such that the lever 13 extends substantially parallel to the threaded shaft 22. The threaded shaft 22 is inserted until the side edges 33 of the first and second driving members 17, 18 of the lever 13 abut the first flange 3. In this position, the first and second driving members 17, 18 are positioned between the extensions 7, 8. The knurled nut 23 is threaded onto the threaded shaft 22 and is advanced onto the threaded shaft 22 until it substantially abuts the second flange 4 or to some other desired position that will result in a sufficient clamping force upon rotation of the lever 13 as will be described below.

An electrical cable 29 is secured by the crimp member 28 to the ring terminal 27. The threaded stud 24 of the terminal receiving member 11 is inserted into the opening of the ring 30 of the ring terminal 27 such that the ring 30 is positioned adjacent to the terminal receiving member 11. The washer 25 is inserted onto the threaded stud 24. The nut 26 is threaded onto the threaded stud 24 and is advanced until it substantially abuts the washer 25 to electrically connect the electrical cable 29 to the main body 2.

The clamp 10 of the main body 2 is positioned on the battery terminal 31 of a battery 32. The lever 13 is rotated from the open position shown in FIG. 4 to the closed position shown in FIG. 5. In the closed position the lever 13 is positioned substantially perpendicular to the threaded shaft 22 and the bottom surfaces 34 of the first and second driving members 17, 18 of the lever 13 abut the first flange 3. During rotation of the lever 13 from the open position to the closed position, a force is applied to the first and second flanges 3, 4 by the first and second driving members 17, 18 and the knurled nut 23. The force pulls the first and second flanges 3, 4 towards each other so that the distance 35 between the first and second flanges 3, 4 is decreased to a distance 35'. The clamp 10 is thereby tightened about the battery terminal 31 to connect the terminal to the main body 2. The battery terminal 31 is thereby electrically connected to the electrical cable 29.

To disconnect the battery terminal 31 from the main body 2, the lever 13 is rotated from the closed position shown in FIG. 5 to the open position shown in FIG. 4. During rotation of the lever 13 from the closed position to the open position, the force applied to the first and second flanges 3, 4 is released, and the distance 35' between the first and second flanges 3, 4 is restored to the distance 35. The clamp 10 is then capable of being removed from the battery terminal 31.

Alternatively, the lever 13 may be positioned on the side of the second flange 4 of the main body 2, as shown in FIGS. 6 and 7. As shown in FIG. 6, the threaded shaft 22 is inserted through the connecting opening 6 in the second flange 4 and then the connecting opening 6 in the first flange 3. The threaded shaft 22 is inserted until the side edges 33 of the first and second driving members 17, 18 abut the second flange 4. In this position, the first and second driving members 17, 18 are positioned below the extension 7. A knurled nut 23 is threaded onto the threaded shaft 22 and is advanced until it substantially abuts the first flange 3 or to some other desired position that will result in a sufficient clamping force upon rotation of the lever 13. The operation of the battery terminal connector 1 assembled with the lever 13 positioned on the side of the second flange 4 of the main body 2 is substantially the same as the battery terminal connector 1 assembled with the lever 13 positioned on the side of the first flange 3 of the main body 2, therefore further explanation thereof will not be provided.

FIGS. 4-5 and FIGS. 6-7 show the lever 13 as being rotatable between the open position where the lever 13 extends substantially parallel to the threaded shaft 22 and the closed position where the lever 13 is positioned proximate the ring terminal 27. However, the lever 13 may alternatively be positioned such that it is positioned proximate the clamp 10 in the closed position, as illustrated by the phantom lines in FIGS. 4-5 and designated with reference numeral 13'. As shown in FIGS. 4-5 and FIGS. 6-7, it should be understood that 13 and 13' represent the same lever which is rotatable between the open position where the lever 13' extends substantially parallel to the threaded shaft 22 and the closed position where the lever 13 is positioned proximate the clamp 10. Because the assembly and operation of the battery terminal connector 1 is substantially the same regardless of the lever's closed position, further explanation thereof will not be provided.

The battery terminal connector 1 of the invention thereby eliminates the need for tools when mating and unmating the battery terminal 31 with the battery terminal connector 1 by the use of the lever 13. Because the lever 13 may be formed of a non-conductive material, the lever 13 also prevents accidental shock or short circuiting. Additionally, the lever 13 is reversible so that the battery terminal connector 1 can easily be adapted for use in differing battery 32 and battery terminal 31 arrangements. Further, the terminal receiving member 11 allows for easy connection of the electrical cable 29 to the battery terminal connector 1 through the use of the threaded stud 24, washer 25, and nut 26. The arrangement of the side wall 9 extending from the first flange 3 to support the terminal receiving member 11 also results in an improved construction thus reducing the risk of bending or fracture of the terminal receiving member 11.

What is claimed is:

1. A battery terminal connector, comprising:

a clamp having opposing first and second flanges extending from ends thereof;

a terminal receiving member extending from the first flange;

a non-conductive lever removeably attached to the first and second flanges by a threaded shaft and a knurled nut, the lever being rotatable between an open position and a closed position wherein it remains in direct contact with one of the flanges, the lever and the knurled nut pulling the first and second flanges toward each other in the closed position; and a ring terminal having a ring connected to the terminal receiving member.

2. The battery terminal connector of claim 1, wherein the terminal receiving member is formed as a plate and extends substantially perpendicular to the first flange.

3. The battery terminal connector of claim 2 further comprising a side wall extending approximately perpendicularly from the first flange.

4. The battery terminal connector of claim 3 wherein the terminal receiving member extends from the side wall.

5. The battery terminal connector of claim 1, wherein the ring is connected to the terminal receiving member by a threaded stud and nut.

6. The battery terminal connector of claim 1, wherein the clamp and the first and second flanges are resilient.

7. The battery terminal connector of claim 1, wherein the ring terminal further comprises a crimp member.

8. The battery terminal connector of claim 1, wherein the lever is positioned proximate the ring terminal in the closed position.

9. The battery terminal connector of claim 1, wherein the lever is positioned proximate the clamp in the closed position.

10. The battery terminal connector of claim 1, wherein the lever is positionable in four different locations when in the closed position.

11. A battery terminal connector, comprising:

a main body including a clamp having first and second flanges extending from ends thereof and a terminal receiving member extending from the first flange;

a lever removeably attached to the first and second flanges, the lever having an eccentric portion with first and second drive members, the first and second drive members directly engaging the first flange and having a rod extending there between that is positioned closer to a side edge than a bottom edge of the first and second drive members, the lever being rotatable between an open position where the side edge engages the first flange and a closed position where the bottom edge engages the first flange, the lever pulling the first and second flanges toward each other in the closed position; and a ring terminal having a ring connected to the terminal receiving member.

12. The battery terminal connector of claim 11, wherein the lever is non- conductive.

13. The battery terminal connector of claim 11, wherein the main body is integrally formed from a conductive material.

14. The battery terminal connector of claim 11, wherein the main body is integrally formed from a tin plated alloy.

15. The battery terminal connector of claim 11, wherein the terminal receiving member is formed as a plate and extends substantially perpendicular to the first flange.

16. The battery terminal connector of claim 15, further comprising a side wall extending approximately perpendicularly from the first flange.

17. The battery terminal connector of claim 16, wherein the terminal receiving member extends from the side wall.

18. The battery terminal connector of claim 11, wherein the ring terminal further comprises a crimp member.

19. The battery terminal connector of claim 11, wherein the ring is connected to the terminal receiving member by a threaded stud and nut.

20. The battery terminal connector of claim 11, wherein the clamp and the first and second flanges are resilient.

21. The battery terminal connector of claim 11, wherein the lever is positioned proximate the ring terminal in the closed position.

22. The battery terminal connector of claim 11, wherein the lever is positioned proximate the clamp in the closed position.

23. The battery terminal connector of claim 11, wherein the lever is positionable in four different locations when in the closed position.

24. A battery terminal connector, comprising:

a main body including a clamp having first and second flanges extending from ends thereof and a terminal receiving member extending from the first flange, the terminal receiving member being substantially plate-like and extending substantially perpendicular to the first flange; and a lever removeably attached to the first and second flanges by a threaded shaft and a knurled nut, the lever being connected to the threaded shaft by an eyelet formed by a curved portion of the threaded shaft and being rotatable between an open position and a closed position, the lever pulling the first and second flanges toward each other in the closed position.

25. The battery terminal connector of claim 24, wherein a ring terminal having a ring is connected to the terminal receiving member by a threaded stud and nut.

26. The battery terminal connector of claim 25, wherein the lever is positioned proximate the ring terminal in the closed position.

27. The battery terminal connector of claim 24, wherein the main body is integrally formed from a conductive material.

28. The battery terminal connector of claim 27, wherein the lever is non- conductive.

29. The battery terminal connector of claim 24, wherein the main body is integrally formed from a tin plated alloy.

30. The battery terminal connector of claim 24, wherein the terminal receiving member extends from a side wall which extends substantially perpendicular from the first flange.

31. The battery terminal connector of claim 24, wherein the clamp and the first and second flanges are resilient.

32. The battery terminal connector of claim 24, wherein the lever is positioned proximate the clamp in the closed position.

33. The battery terminal connector of claim 24, wherein the lever is positionable in four different locations when in the closed position.

34. A battery terminal connector, comprising:

a main body including a clamp having first and second flanges extending from ends thereof and a terminal receiving member extending from the first flange, the terminal receiving member being substantially plate-like and extending substantially perpendicular to the first flange; and a lever removeably attached to the first and second flanges by a threaded shaft and a knurled nut, the lever being connected to the threaded shaft by an eyelet and being rotatable between an open position and a closed position, the lever pulling the first and second flanges toward each other in the closed position;

wherein a ring terminal having a ring is connected to the terminal receiving member by a threaded stud and nut; and wherein the lever is positioned proximate the ring terminal in the closed position.

35. A battery terminal connector, comprising:

a main body including a clamp having first and second flanges extending from ends thereof and a terminal receiving member extending from the first flange, the terminal receiving member being substantially plate-like and extending substantially perpendicular to the first flange; and a lever removeably attached to the first and second flanges by a threaded shaft and a knurled nut, the lever being connected to the threaded shaft by an eyelet and being rotatable between an open position and a closed position, the lever pulling the first and second flanges toward each other in the closed position;

wherein the lever is positionable in four different locations when in the closed position.

* * * * *